US005236119A

United States Patent [19]

Chu

[11] Patent Number: 5,236,119

[45] Date of Patent: Aug. 17, 1993

[54] PAPER PLATE

[76] Inventor: Ming-Hsiang Chu, No. 14, Lane 31, Cheng Kung Rd., Tai Ping Hsiang, Taichung Hsien, Taiwan

[21] Appl. No.: 971,561

[22] Filed: Nov. 5, 1992

[51] Int. Cl.[5] ..... B65D 1/36; B65D 1/44

[52] U.S. Cl. ..... 229/2.5 R; 220/527; 220/555; 220/556; 220/575

[58] Field of Search ..... 229/2.5 R; 220/574, 220/575, 527, 555, 556

[56] References Cited

U.S. PATENT DOCUMENTS

| | | | |
|---|---|---|---|
| 1,595,356 | 8/1926 | Moseman | 229/2.5 R |
| 1,848,066 | 3/1932 | Shepard et al. | 229/2.5 R |
| 2,703,185 | 3/1955 | Cook | 229/2.5 R |
| 2,738,915 | 3/1956 | Clair | 229/2.5 R |
| 3,067,922 | 12/1962 | Hill | 229/2.5 R |
| 3,401,863 | 9/1968 | Earl | 229/2.5 R |
| 3,633,785 | 1/1972 | Cyr et al. | 229/2.5 R |
| 3,675,811 | 7/1972 | Artz | 220/575 |
| 3,708,086 | 1/1973 | Colato | 220/575 |
| 4,219,144 | 8/1980 | Hagelberg | 229/2.5 R |
| 4,298,133 | 11/1981 | Davis | 229/2.5 R |
| 4,718,555 | 1/1988 | Amberg | 229/2.5 R |

*Primary Examiner*—Gary E. Elkins

*Attorney, Agent, or Firm*—Morton J. Rosenberg; David I. Klein

[57] ABSTRACT

A paper plate (1) is provided which is pressure formed from a substantially rectangularly contoured paper board blank having corner sections. The corner sections include a plurality of fanned indentations (2) with the paper board blank being fabricated into the paper plate (1) through pressure formation. The fanned indentations (2) form corner creases after the paper plate (1) is pressure formed. Additionally, the pressure plate (1) defines rib members (5) which divide the paper plate (1) into individual compartments. A plurality of crescent contoured indentations (3) are provided on the paper board blank with the crescent contoured indentations (3) forming a stiffening fold member (6) which lies adjacent to and spans a top surface of a respective pressure formed rib member (5) to provide a double layer of paper board adjacent the respective rib member (5) for resisting deformation of the paper plate (1) when loads are applied.

2 Claims, 4 Drawing Sheets

PAPER PLATE

BACKGROUND OF THE INVENTION

This invention relates to an improvement for paper plate with excellent stiffness.

Referring to FIG. 5, the paper plate on today's market involves such defect as the deficiency of stiffness. Where there is food fully loaded the paper plate it often gets deformed due to the weight of load to cause the spill of food from it.

SUMMARY OF THE INVENTION

This invention is to provided an improved paper plate with excellent stiffness in order to solve the above-said defect.

Where there is food fully loaded the improve paper plate, it may develop sufficient stiffness as to protect food against spilling from it.

The improved paper plate according to this invention, in general, is pressure formed from a rectangular paper board having round corners which have plural indentations respectively. The indentations include plural strips of indentations fanned out over each corner of the rectangular paper board, plural crescent indentations and adjacent linear indentations. The rectangular paper board is fabricated into a paper plate by means of pressure formation wherein including corner creases shaped from those fanned-out indentations, stiffening folds formed from those crescent indentations, and ribs formed during the process of pressure formation for dividing the paper plate into several portions.

DETAILED DESCRIPTION OF PREFERRED EMBODIMENTS

Figure 1:
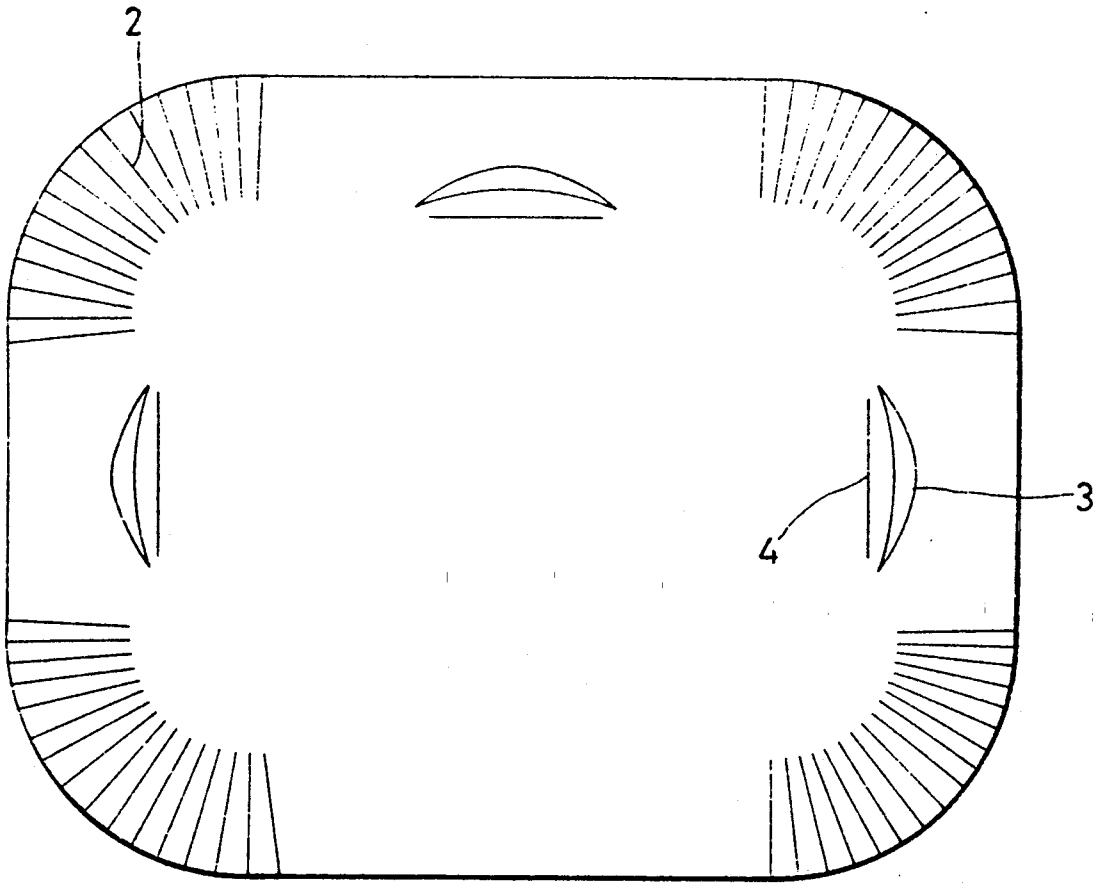
FIG. 1 is a plane view showing a paper blank with indentations before making into the improved paper plate according to this invention.

Referring to the drawings, the improved paper plate 1 according to this invention is fabricated from a paper board. For making into such an improved paper plate 1, the paper board of appropriate size and material is made with indentations at proper positions as shown on FIG. 1, Referring to the paper board for making into the improved paper plate of this invention, the indentations thereon include plural strips of indentations 2 fanned out over each of four corners, plural crescent indentations 3 and linear indentations 4 preferably located adjacent to each crescent indentation 3. The linear indentations 4 are provided for absorbing adjacent deformations of paper board during the process of pressure formation in order to eliminate creases appearing on unexpected positions.

Figure 2:
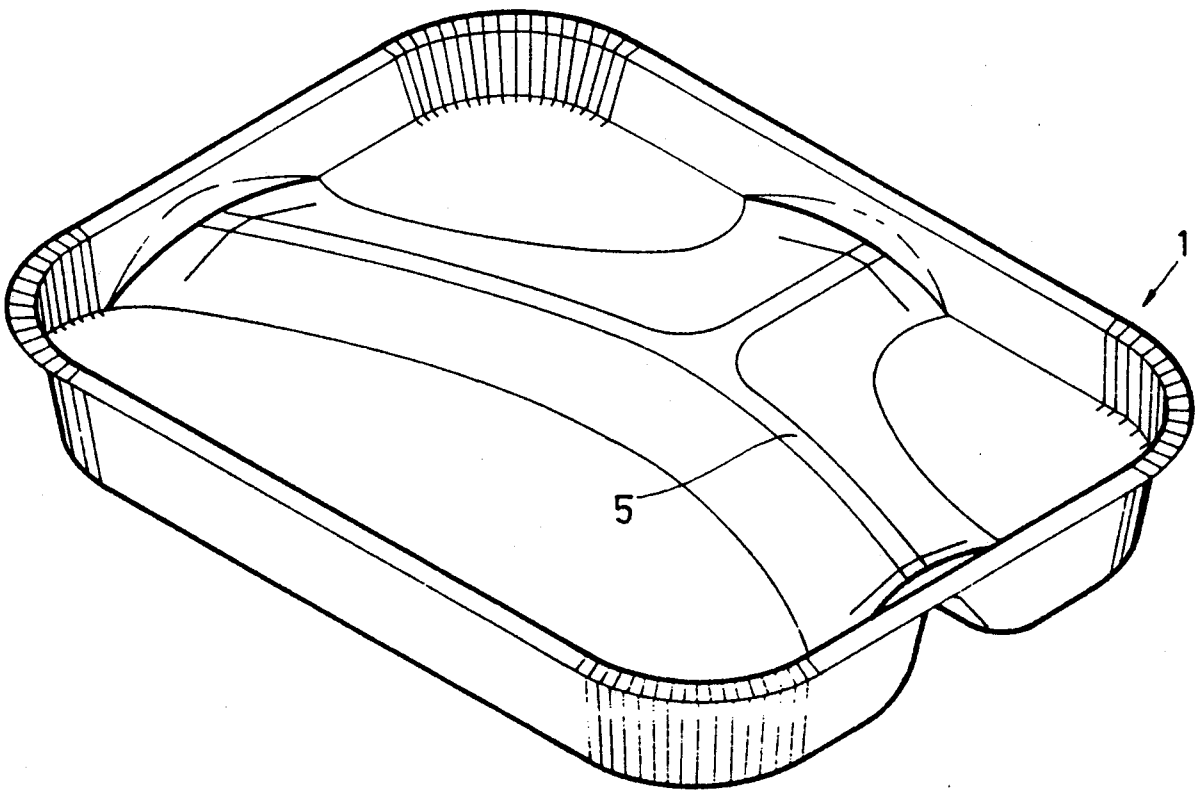
FIG. 2 is a perspective view of the improved paper plate according to this invention.

Place the paper board with indentations as shown on FIG. 1 in the formation machine and the improved paper plate 1 as shown on FIG. 2 can be produced by using a suitable pressure mold wherein including ribs 5 for dividing the plate into several portions.

Referring to FIG. 1, each crescent indentation 3 forms the final end of each rib 5 to be formed. During the process of pressure formation, each crescent indentation 3 is effective to help stiffening folds 6 to be rolled in from top to the bottom and then rolled out.

Figure 3:
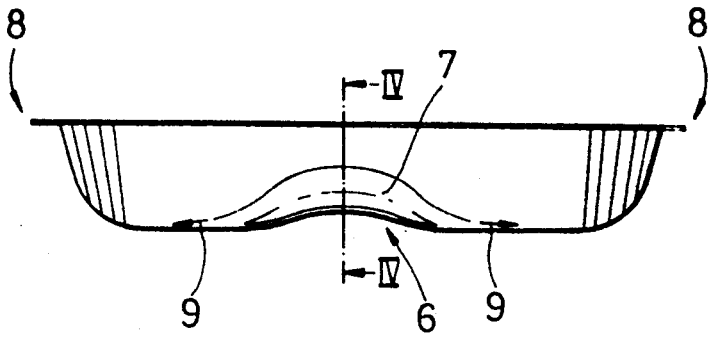
FIG. 3 is a view of stiffening folds on the improved paper plate of this invention.
Figure 4:
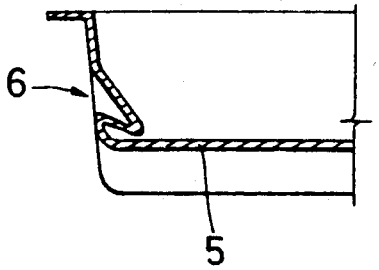
FIG. 4 is an exploded of stiffening folds.
Figure 5:
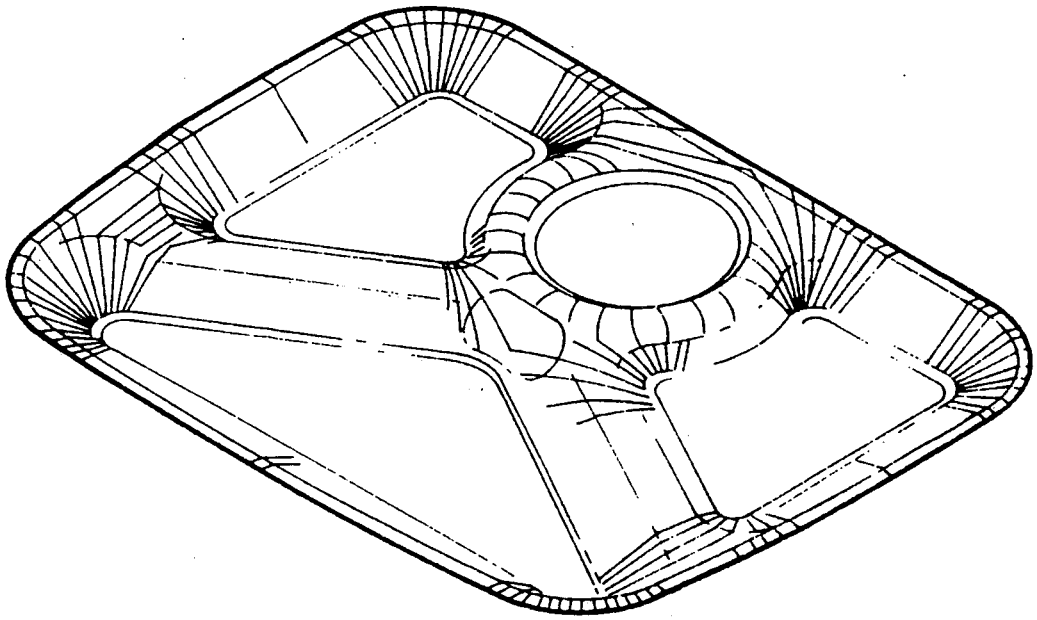
F I G. 5 PRIOR ART
FIG. 5 is a perspective view of the paper plate on today's market.

Those stiffening folds 6 include a folding portion 7 over relevant rig 5. Referring to FIG. 3, when the paper plate sustains a bending moment represented by an arrow 8, the folding portion 7 formed by double-layer paper board will push onto the relevant rib 5 in a longitudinal manner and meanwhile be pulled longitudinally (as shown by arrow 9 on FIG. 3). As the double-layer paper board is provided to sustain torsional moment while the folding portion 7 pushes onto the rib 5 so that the longitudinal tensile force of folding portion 7 is provided to resist to bending moment. In substance therefore, the stiffening folds 6 are effective greatly to increase stiffness of paper plate.

I claim:

1. A paper plate pressure formed from a substantially rectangularly contoured paper board blank having rounded sections, each of said corner sections having a plurality of fanned indentations formed therein, said paper board blank being fabricated into said paper plate by means of pressure formation defining corner creases shaped from said fanned indentations and further defining rib members for dividing said paper plate into individual compartments, wherein the improvement comprises:

a plurality of pre-formed indentations formed within said paper board blank including a plurality of crescent contoured indentations, each of said crescent contoured indentations forming a stiffening fold member adjacent to and spanning a top surface of a respective pressure formed rib member, said stiffening fold member providing a double-layer of paper board adjacent said respective rib member for resisting deformation of said paper plate when loads are applied.

2. The paper plate as recited in claim 1 wherein said plurality of pre-formed indentations includes at least one linearly directed indentation formed adjacent a respective one of said crescent contoured indentations for absorbing deformations of said paper board blank during said pressure formation of said paper plate.

* * * * *